US007892031B1

(12) United States Patent
Mostoller et al.

(10) Patent No.: US 7,892,031 B1
(45) Date of Patent: Feb. 22, 2011

(54) QUICK INSERTION LAMP ASSEMBLY

(75) Inventors: Matthew Edward Mostoller, Hummelstown, PA (US); Christopher George Daily, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 14 days.

(21) Appl. No.: 12/512,808

(22) Filed: Jul. 30, 2009

(51) Int. Cl.
*H01R 5/50* (2006.01)

(52) U.S. Cl. ..... 439/611; 439/266; 439/300; 313/317; 313/580

(58) Field of Classification Search ..... 439/266, 439/300, 611–619; 313/317, 580
See application file for complete search history.

(56) References Cited

U.S. PATENT DOCUMENTS

| | | | | |
|---|---|---|---|---|
| 2,722,668 | A | 11/1955 | Wellington | |
| 3,215,972 | A | 11/1965 | Eriksson | |
| 3,478,300 | A | 11/1969 | Griffin | |
| 5,197,891 | A | 3/1993 | Tanigawa et al. | |
| 5,545,950 | A * | 8/1996 | Cho | 315/56 |
| 5,550,422 | A * | 8/1996 | Sulcs et al. | 313/25 |
| 6,089,902 | A | 7/2000 | Daoud | |
| 6,190,210 | B1 | 2/2001 | Belopolsky et al. | |
| 6,287,130 | B1 | 9/2001 | Torii | |
| 6,558,205 | B1 | 5/2003 | Shi et al. | |
| 6,733,319 | B1 | 5/2004 | Jørgensen | |
| 6,848,950 | B2 | 2/2005 | Allison et al. | |
| 6,848,953 | B2 | 2/2005 | Schell et al. | |
| 7,116,043 | B2 * | 10/2006 | Tomiyoshi et al. | 313/317 |
| 7,198,500 | B1 * | 4/2007 | Lin | 439/300 |
| 7,220,141 | B2 | 5/2007 | Daily et al. | |
| 7,258,562 | B2 | 8/2007 | Daily et al. | |
| 7,261,579 | B2 | 8/2007 | Ku et al. | |
| 7,360,922 | B1 * | 4/2008 | Yeh | 362/217.05 |
| 7,374,436 | B2 | 5/2008 | Schell et al. | |
| 7,394,189 | B2 * | 7/2008 | Kitagawa et al. | 313/318.1 |
| 7,402,064 | B2 | 7/2008 | Daily et al. | |
| 7,452,249 | B2 | 11/2008 | Daily et al. | |
| 7,458,839 | B2 | 12/2008 | Ngo et al. | |
| 7,470,160 | B1 | 12/2008 | Mostoller et al. | |
| 7,479,038 | B2 * | 1/2009 | Weng | 439/615 |
| 7,513,793 | B2 | 4/2009 | Horst et al. | |
| 7,530,849 | B2 * | 5/2009 | Colosio | 439/619 |
| 7,540,761 | B2 * | 6/2009 | Weber et al. | 439/487 |
| 7,547,214 | B2 | 6/2009 | Duesterhoeft et al. | |
| 2002/0098743 | A1 | 7/2002 | Schell et al. | |
| 2003/0181106 | A1 | 9/2003 | Schell et al. | |

(Continued)

OTHER PUBLICATIONS

International Search Report, International Application No. PCTUS2010/002122, International Filing Date, Jul. 29, 2010.

*Primary Examiner*—Truc T Nguyen

(57) ABSTRACT

A lamp assembly includes a light source, a contact base, a center contact and an outer contact. The contact base extends from a lower end to an upper end along a center axis. The upper end is interconnected with the light source and the lower end is configured to be received in a socket to mate the contact base with the socket. The center contact is disposed proximate the lower end of the contact base and is electronically coupled with the light source. The outer contact includes a ring body and an elongated contact tine. The ring body encircles the center contact proximate the lower end of the contact base. The center contact and the outer contact are mechanically and electrically coupled with the socket and electrically join the light source with an electric ground reference.

20 Claims, 7 Drawing Sheets

U.S. PATENT DOCUMENTS

| | | | |
|---|---|---|---|
| 2005/0136713 | A1 | 6/2005 | Schell et al. |
| 2005/0181643 | A1 | 8/2005 | Brower et al. |
| 2006/0003620 | A1 | 1/2006 | Daily et al. |
| 2006/0189194 | A1 | 8/2006 | Daily et al. |
| 2006/0228927 | A1 | 10/2006 | Daily et al. |
| 2006/0258123 | A1 | 11/2006 | Forbes |
| 2006/0258213 | A1 | 11/2006 | Ku et al. |
| 2006/0281354 | A1 | 12/2006 | Ngo et al. |
| 2007/0202748 | A1 | 8/2007 | Daily et al. |
| 2008/1003726 | | 2/2008 | Wesson |
| 2008/0153344 | A1 | 6/2008 | Horst et al. |
| 2008/0182439 | A1 | 7/2008 | Schell et al. |
| 2008/0214027 | A1 | 9/2008 | Schell et al. |
| 2008/0274641 | A1 | 11/2008 | Weber et al. |
| 2009/0075519 | A1 | 3/2009 | Daily et al. |
| 2009/0130889 | A1 | 5/2009 | Daily et al. |

* cited by examiner

QUICK INSERTION LAMP ASSEMBLY

CROSS-REFERENCE TO RELATED APPLICATIONS

This application is related to co-pending U.S. patent application Ser. No. 12/144,241, filed Jun. 23, 2008, and entitled "Through Board Inverted Connector" (the "'241 Application") and co-pending U.S. patent application Ser. No. 12/512,760, filed concurrently with this application, and entitled "Through Board Inverted Connector" (the "GI-00677 Application"). The entire disclosures of the '241 and the GI-00677 Applications are hereby incorporated by reference herein in their entirety.

BACKGROUND OF THE INVENTION

The subject matter herein relates generally to lighting systems, and more particularly, to lamp assemblies.

Many known lighting systems include light sources that have an Edison-style base that is screwed into a socket. For example, the light sources may include a threaded end that is screwed into a socket to electrically couple the light source with the socket. The socket is joined with a source of electric current and a ground reference to supply power to the light source such that the light source may generate light. The screwing of the light sources into the socket typically requires several complete rotations of the light source relative to the socket to ensure that the light source is both mechanically secured to the socket and electrically coupled with the socket.

The screw-type interconnection of the light source to the socket is not without problems. Failure to fully-screw the light source into the socket may result in the light source being mechanically secured to the socket without the light source being electrically coup led with the socket. Consequently, the light source may not receive electric current via the socket to generate light. On the other hand, fully screwing the light source into the socket may require multiple complete rotations of the light source into the socket and may requite a relatively significant amount of time.

A need exists for lighting systems that more easily and quickly mechanically and electrically couple light sources to sockets in order to supply electric current to the light sources in the lighting systems.

BRIEF DESCRIPTION OF THE INVENTION

In one embodiment, a lamp assembly that mates with a socket having an internal thread is provided. The lamp assembly includes a light source, a contact base, a center contact and an outer contact. The light source is configured to generate light. The contact base extends from a lower end to an upper end along a center axis. The upper end is interconnected with the light source and the lower end is configured to be received in the socket to mate the contact base with the socket. The center contact is disposed proximate the lower end of the contact base and is electronically coupled with the light source. The outer contact includes a ring body and an elongated contact tine. The ring body encircles the center contact proximate the lower end of the contact base. The elongated contact tine extends from the ring body to an outer end. The center contact and the outer contact are mechanically and electrically coupled with the socket and electrically join the light source with an electric ground reference.

In another embodiment, a contact base for a lamp assembly having a light source is provided. The contact base includes an elongated body, a center contact and an outer contact. The body extends between a lower end and an upper end along a center axis. The upper end is interconnected with the light source and the lower end is configured to be received in a socket having an internal thread to mate the lamp assembly with the socket. The center contact is disposed proximate to the lower end of the elongated body between the lower end and the socket when the elongated body is loaded into the socket. The center contact is configured to be electronically coupled with the light source. The outer contact includes a ring body and an elongated contact tine. The outer contact is configured to be electronically joined with the light source. The ring body encircles the center contact proximate the lower end of the contact base. The contact tine extends from the ring body to an outer end. The center and outer contacts engage the socket to electronically couple the light source with the socket and the elongated contact tine engages the internal thread of the socket to secure the base to the socket.

DETAILED DESCRIPTION OF THE

Figure 1:
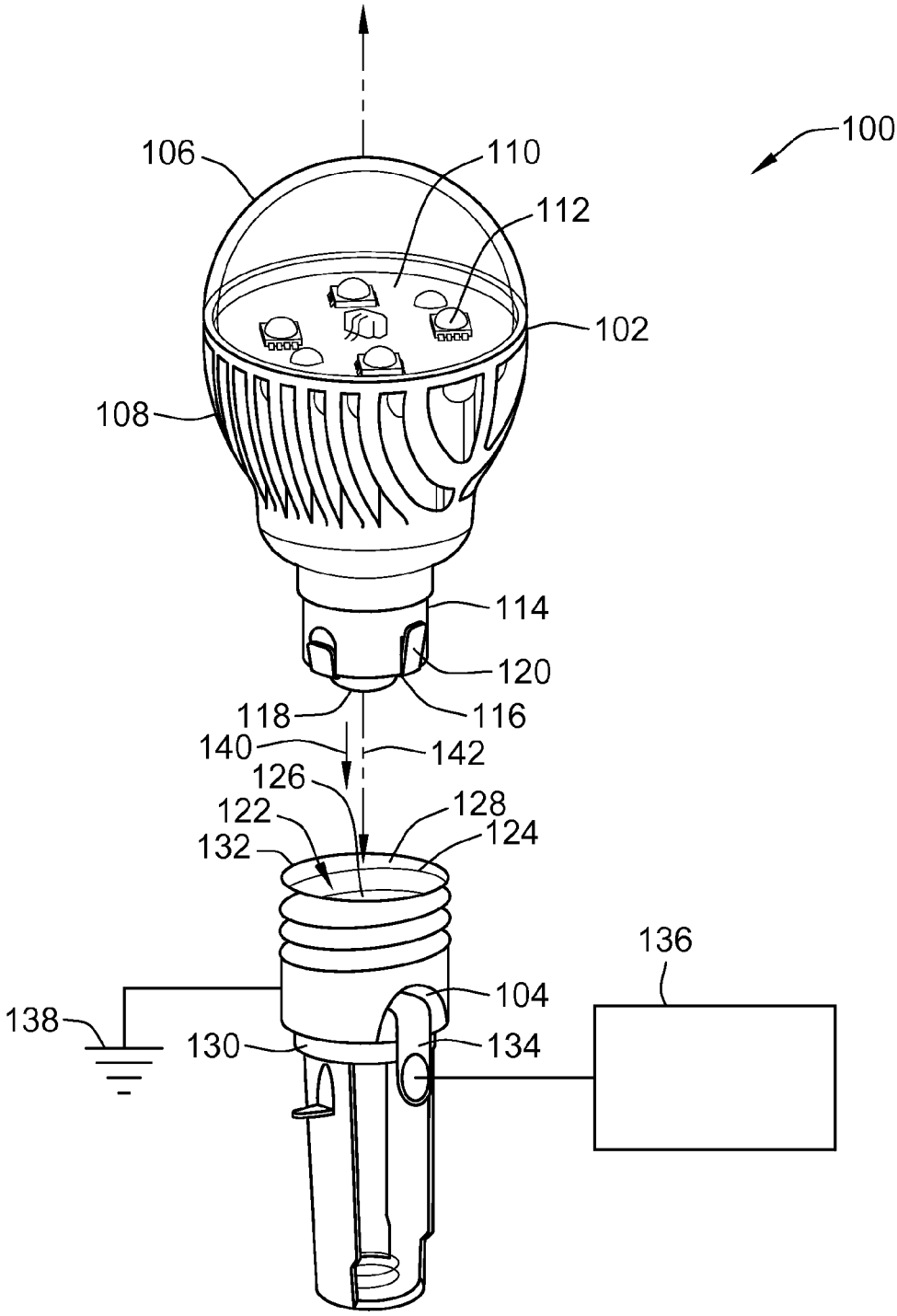
FIG. 1 is a perspective view of a lighting system in accordance with one embodiment of the present disclosure.

FIG. 1 is a perspective view of a lighting system 100 in accordance with one embodiment of the present disclosure. The lighting system 100 includes a lamp assembly 102 that mates with a socket 104. The lamp assembly 102 generates light from electric power or current that is received from the socket 104. In the illustrated embodiment, the lamp assembly 102 is a light emitting diode (LED) lighting device. Alternatively, the lamp assembly 102 may be another type of lighting device, such as an incandescent, halogen, or metal halide lighting device. The lamp assembly 102 includes a light-transmissive lens 106 that is coupled with a heat sink 108. A circuit board 110 is coupled to the heat sink 108 in a location that is proximate to, or slightly below, the interface between the lens 106 and the heat sink 108. By way of example only, the circuit board 110 may be a metal clad printed circuit board or an FR4 circuit board. Several light sources 112 are mounted to the circuit board 110. In the illustrated embodiment, the light sources 112 are LEDs. The light sources 112 receive electric power from the socket 104 via the lamp assembly 102 and convert the power into light. The light generated by the light sources 112 propagates through the lens 106 to illuminate areas outside of the lamp assembly 102. Thermal energy or heat that also may be generated by the light sources 112 is dissipated into the atmosphere surrounding the lamp assembly 102 by the heat sink 108. For example, the heat sink 108 may be a thermally conductive body, or a body that includes a thermally conductive material, that transmits thermal energy outside of the lamp assembly 102.

The heat sink 108 is joined to a contact base 114. The contact base 114 is an elongated body that is oriented along a center axis 142 and extends between an upper end 300 (shown in FIG. 3) and an opposite lower end 116 along a center axis 142. The contact base 114 includes an interior chamber 304 (shown in FIG. 3) that extends between the upper and lower ends 300, 116. The elongated body of the contact base 114 may include, or be formed from, a dielectric material in the illustrated embodiment. The upper end 300 of the contact base 114 is joined with the heat sink 108. The upper end 300 may be coupled with the heat sink 108 by screwing the contact base 114 into the heat sink 108, by using heat staking, or some other manner of attachment. The contact base 114 is interconnected with the light sources 112 by the heat sink 108, the circuit board 110 and one or more additional components. For example, the contact base 114 may be mechanically coupled with the light sources 112 by the heat sink 108 and the circuit board 110 and be electrically coupled with the light sources 112 by one or more electrical components, such as one or more card modules, wires, connectors, and the like.

A center contact 118 and an outer contact 120 are joined to the contact base 114. For example, the center contact 118 and the outer contact 120 may be coupled to the contact base 114 at, or proximate to, the lower end 116 of the contact base 114. The center contact 118 and the outer contact 120 are electrically interconnected with the light sources 112. For example, one or more wires, card modules, connectors, and the like may provide an electrically conductive pathway between the light sources 112 and the center and outer contacts 118, 120.

The socket 104 includes a generally cylindrical body that receives the contact base 114 of the lamp assembly 102 when the lamp assembly 102 and socket 104 mate with one another. The socket 104 shown in FIG. 1 is shaped similar to an Edison type lamp base. For example, the socket 104 may be sized and have dimensions similar to E10, E11, E12, E14, E17, E26 (MES), E27 (ES), E39 or E40(GoliathES) screw-in lamp bases. The socket 104 extends from a base end 130 to a top end 132 and includes an interior chamber 122 that extends therebetween. A feed line contact 134 is disposed in the interior chamber 122 above the base end 130. The feed line contact 134 is electrically coupled with an electric power source 136, such as a source of direct or alternating current.

The socket 104 includes an internal threaded surface 124 in the interior chamber 122. The internal threaded surface 124 includes a thread that helically winds around the internal threaded surface 124. The thread may be divided into two or more thread portions 126, 128, with each thread portion 126, 128 being separated from one another by a thread pitch 504 (shown in FIG. 5) of the internal threaded surface 124. For example, the thread portions 126, 128 may be adjacent ridges 502 (shown in FIG. 5) of the internal threaded surface 124 that are separated from one another by the thread pitch 504. Alternatively, the thread portions 126, 128 may be non-adjacent ridges 502 of the internal threaded surface 124.

The socket 104 is electrically joined with an electric ground reference 138. For example, the internal threaded surface 124 may be coupled with the ground reference 138. The lamp assembly 102 mates with the socket 104 to electrically couple the lamp assembly 102 with the power source 136 and the ground reference 138. The center contact 118 of the lamp assembly 102 may be disposed between the feed line contact 134 and the contact base 114 so as to engage the feed line contact 134 of the socket 104 when the lamp assembly 102 and socket 104 mate. The center contact 118 electrically couples the light sources 112 of the lamp assembly 102 with the power source 136 via the feed line contact 134. The outer contact 120 of the lamp assembly 102 may engage the internal threaded surface 124 of the socket 104 to electrically couple the light sources 112 and/or the lamp assembly 102 with the ground reference 138 when the lamp assembly 102 and socket 104 mate. The power source 136 may then supply electric power or current to the light sources 112 so the light sources 112 can generate light that emanates through the lens 106.

In one embodiment, the base 114 of the lamp assembly 102 is a quick-insertion base that mates with the socket 104 with less movement of the lamp assembly 102. The base 114 may electrically and mechanically couple with the internal threaded surface 124 and the feed line contact 134 of the socket 104 by inserting the base 114 into the socket 104 along a linear mating direction 140 and then twisting or rotating the base 114 and/or the socket 104 relative to one another around the mating direction 140 by one or less full rotations, or 360 degrees or less of rotation. For example, the base 114 may mechanically couple the lamp assembly 102 to the socket 104 such that the lamp assembly 102 cannot be removed from the socket 104 without rotating the base 114 and/or socket 104 in an opposite direction. In one embodiment, the base 114 mechanically secures and electronically joins the lamp assembly 102 to the socket 104 by rotating the base 114 relative to the socket 104 by one half rotation or less, or 180 degrees or less of rotation. In another embodiment, the base 114 may secure and join the lamp assembly 102 to the socket 104 by one quarter rotation or less, or 90 degrees or less of rotation.

Figure 2:
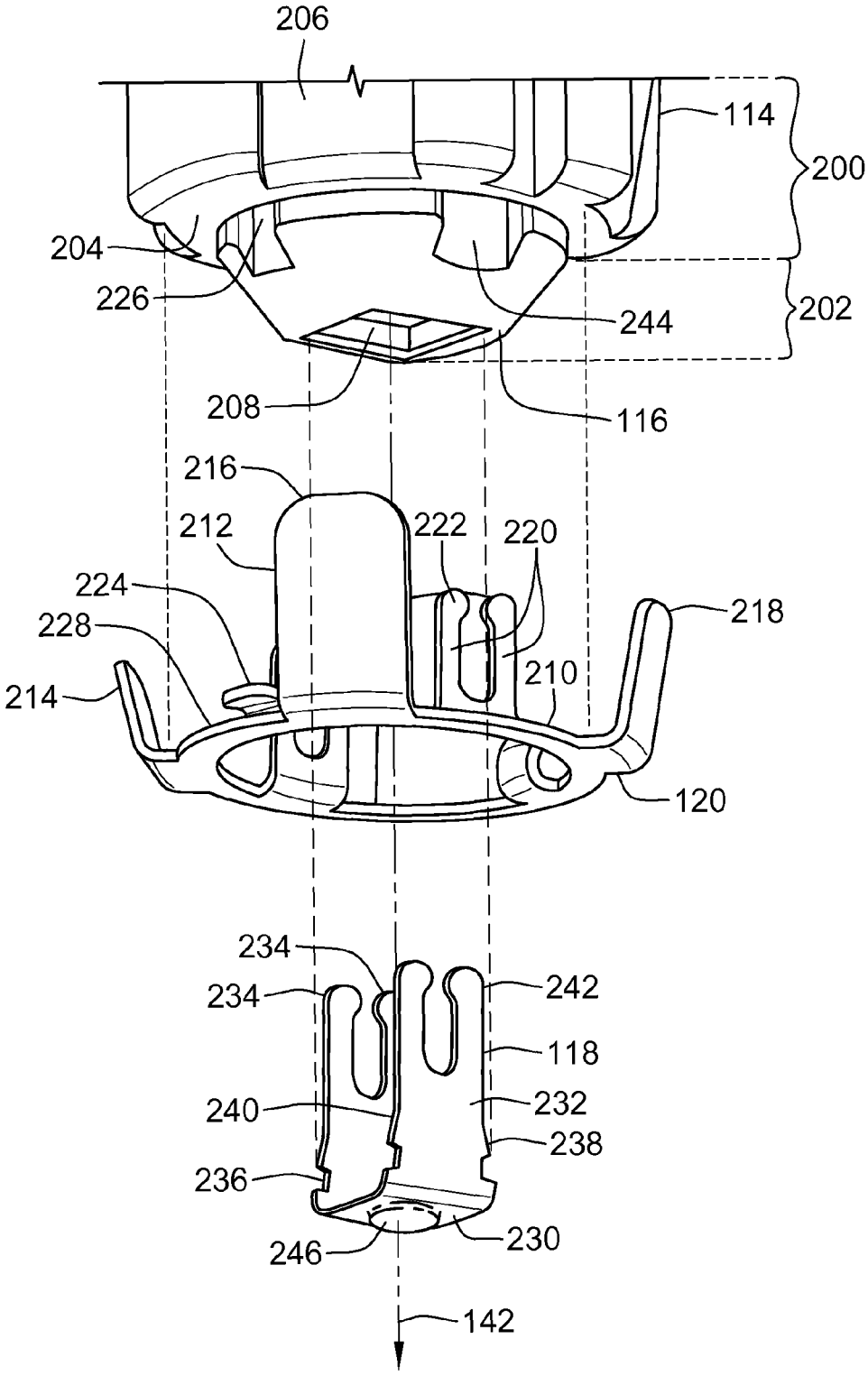
FIG. 2 is an exploded view of a lower end of a contact base shown in FIG. 1 in accordance with one embodiment of the present disclosure.

FIG. 2 is an exploded view of the lower end 116 of the contact base 114 in accordance with one embodiment of the present disclosure. The lower end 116 includes a generally cylindrical portion 200 coupled with a narrowed portion 202. The cylindrical portion 200 is separated from the narrowed portion 202 by a rim ledge 204. The cylindrical portion 200 may have an approximately constant outer diameter along a length of the contact base 114 while the narrowed portion 202 has an outer diameter that changes along a different length of the contact base 114. The cylindrical portion 200 includes recesses 206 that are formed as sunken areas of the contact base 114 that recess into the contact base 114 from the exterior surface of the contact base 114 and extend along a length of the contact base 114.

The narrowed portion 202 extends from the cylindrical portion 200 at the rim ledge 204 to the lower end 116 of the contact base 114. The narrowed portion 202 has a smaller outside diameter at or proximate to the lower end 116 than at the rim ledge 204. The narrowed portion 202 includes retention openings 226 and contact openings 244 that extend inward to the interior chamber 304 (shown in FIG. 3) of the contact base 114. For example, the retention openings 226 and the contact openings 244 may provide access to the interior chamber 304 from the exterior of the contact base 114. In the illustrated embodiment, a pair of the retention openings 226 and a pair of the contact openings 244 are disposed adjacent to the rim ledge 204. The retention openings 226 are disposed opposite one another along the circumference or perimeter of the rim ledge 204 and the contact openings 244 are disposed opposite one another along the circumference or perimeter of the rim ledge 204. Alternatively, a different number of the retention openings 226, and/or contact openings 244 may be provided. In another embodiment, the retention openings 226 and/or contact openings 244 are located in different positions than those shown in FIG. 2.

The narrowed portion 202 includes a contact opening 208 in the lower end 116. The contact opening 208 may be aligned with the center axis 142 of the contact base 114. The contact opening 108 extends into the interior chamber 304 (shown in FIG. 3) to provide access to the interior chamber 304 from outside of the contact base 114. In the illustrated embodiment, the contact opening 208 has a square shape. Alternatively, the contact opening 208 may have a different shape. While only a single contact opening 208 is shown, a different number of contact openings 208 may be provided.

The contact base 114 includes only a single outer contact 120 and only a single center contact 118 in the illustrated embodiment. Alternatively, the contact base 114 may include a different number of the outer contact 120 and/or the center contact 118. The outer contact 120 includes a ring body 210 joined to several contact tines 212, 214. The ring body 210 may have a circular shape. Alternatively, the ring body 210 may have a different shape, such as the shape of a polygon. The ring body 210 encircles the center contact 118 at or proximate to the lower end 116 of the contact base 114. An upper surface 228 of the ring body 210 may engage the rim ledge 204 of the contact base 114 when the outer contact 120 is assembled to the contact base 114. The outer contact 120 includes, or is formed from, a conductive material. The outer contact 120 may be a unitary body. For example, the outer contact 120 may be stamped and formed from a common sheet of metal or metal alloy, such as a copper-based alloy.

The contact tines 212, 214 are cantilevered beams that extend from the ring body 210 to corresponding outer ends 216, 218. In the illustrated embodiment, each of a pair of the contact tines 212 oppose one another and each of a pair of contact tines 214 oppose one another, with the contact tines 212, 214 circumferentially separated from one another along the ring body 210 by approximately 90 degrees. Alternatively, a different number of the contact tines 212 and/or the contact tines 214 may be provided. The contact tines 212, 214 may be positioned differently from the embodiment shown in FIG. 2. The contact tines 212, 214 are angled with respect to the center axis 142. For example, the contact tines 212, 214 may extend from the ring body 210 to the outer ends 216, 218 at angles with respect to the center axis 142. The contact tines 212, 214 may be different lengths. In the illustrated embodiment, the contact tines 212 are longer than the contact tines 214. The contact tints 212, 214 are received in the recesses 206 of the contact base 114. For example, each contact tine 212, 214 may be received in a different, recess 206 when the outer contact 120 is coupled to the contact base 114. The recesses 206 provide clearance for the contact tines 212, 214 to bias toward and away from the center axis 142 when the contact base 114 is inserted into the socket 104 (shown in FIG. 1). The contact tines 212, 214 may flex toward and into the recesses 206 when the contact base 114 is loaded into the socket 104.

The ring body 210 includes opposing contact beams 220 that upwardly extend from the ring body 210. The contact beams 220 are cantilevered beams that extend from the ring body 210 to outer mating ends 222 in directions that are approximately parallel to the center axis 142. Alternatively, the contact beams 220 may be angled with, respect to the center axis 142. The contact beams 220 are loaded into the contact openings 244 of the contact base 114 when the outer contact 120 is assembled to the contact base 114. For example, the mating ends 222 of the contact beams 220 may extend into the interior chamber 304 (shown in FIG. 3) of the contact base 114 when the outer contact 120 is assembled to the contact base 114.

In the illustrated embodiment, the ring body 210 also includes retention features 224 on opposite sides of the perimeter of the ring body 210. The retention features 224 engage the contact base 114 to secure the outer contact 120 to the lower end 116 of the contact base 114. The retention features 224 may be embodied in outwardly curved cantilevered beams, as shown in FIG. 2, or in another structure that engages the contact base 114. The retention features 224 are received in the retention openings 226 of the contact base 114. For example, the retention features 224 may be loaded into the retention openings 226 and snap onto the contact base 114 to secure the outer contact 120 to the contact base 114. Alternatively, the retention features 224 may be loaded into the retention openings 226 and then bent onto the contact base 114 to secure the outer contact 120 to the contact base 114.

The center contact 118 is received into the contact opening 208 of the contact base 114. The center contact 118 includes a contact plate 230 joined to opposing mating plates 232. The center contact 118 may have a U-shape, with the contact plate 230 forming the bottom portion of the U and the mating plates 232 forming the upwardly pointing parts of the U. Alternatively, the center contact 118 may have a different shape. The center contact 118 is disposed within the ring body 210 at or proximate to the lower end 116 of the contact base 114. The center contact 118 includes, or is formed from, a conductive material. The center contact 118 may be a unitary body. For example, the center contact 118 may be stamped and formed from a common sheet of metal or metal alloy, such as a copper-based alloy.

In the illustrated embodiment, each of the mating plates 232 is a substantially planar body that extends upward from the contact plate 230 in directions that are approximately parallel to the center axis 142. The mating plates 232 include opposing contact beams 242 that upwardly extend along the center axis 142 to outer mating ends 234. The contact beams 242 are cantilevered beams that are loaded into the interior chamber 304 (shown in FIG. 3) of the contact base 114 when the center contact 118 is loaded into the contact opening 208.

The mating plates 232 may include retention features 236 that secure the center contact 118 to the contact base 114. For example, the retention features 236 may be slots that extend toward one another from opposite edges 238, 240 of the mating plates 232. The retention features 236 may receive the lower end 116 of the contact base 114 when the center contact 118 is loaded into the contact opening 208 of the contact base 114 to secure the center contact 118 to the lower end 116.

The contact plate 230 interconnects the mating plates 232 along the bottom of the center contact 118. The contact plate 230 may be a substantially planar body having an engagement obtrusion 246. The engagement protrusion 246 includes a portion of the contact plate 230 that extends from the contact plate 230 in a direction along the center axis 142. The engagement protrusion 246 outwardly projects from the center contact 118 to engage the feed line contact 134 (shown in FIG. 1) of the socket 107 (shown in FIG. 1).

Figure 3:
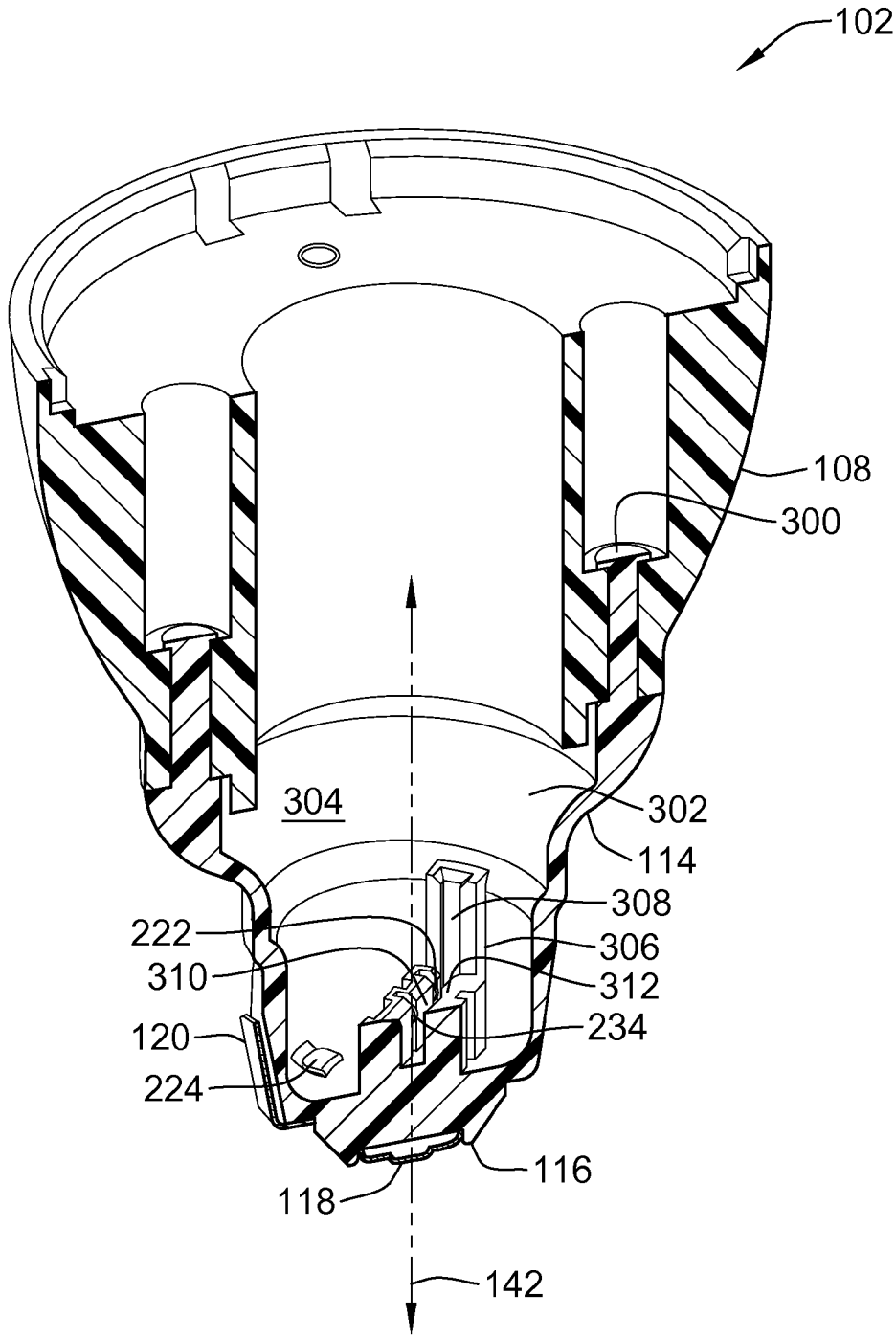
FIG. 3 is a cross-sectional view of a heat sink and contact base of the lamp assembly shown in FIG. 1 in accordance with one embodiment of the present disclosure.

FIG. 3 is a cross-sectional view of the heat sink 108 and contact base 114 of the lamp assembly 102 in accordance with one embodiment of the present disclosure. As described above, the contact base 114 is elongated between the upper end 300 and the lower end 116 along the center axis 142. The upper end 300 is received into the heat sink 108 to couple the contact base 114 with the heat sink 108 and to interconnect the contact base 114 with the circuit board 110 (shown in FIG. 1) and the light sources 112 (shown in FIG. 1).

The contact base 114 includes an interior surface 302 that defines the interior chamber 304. The interior surface 302 includes alignment protrusions 306 that inwardly extend into the interior chamber 304 from the interior surface 302. The alignment protrusions 306 are laterally separated from one another in a direction that is transverse to the center axis 142 and are longitudinally elongated in a direction that is approximately parallel to the center axis 142. The alignment protrusions 306 form a module slot 308 that receives a card module 400 (shown in FIG. 4). The mating ends 222, 234 of the outer contact 120 and the center contact 118 protrude into the interior chamber 304 and into opposing sides 310, 312 of the module slot 308. For example, the contact beams 220, 242 of the outer and center contacts 120, 118 may be linearly aligned with one another along directions that are lateral to the center axis 142 such that the mating ends 222, 234 of the contact beams 220, 242 in each pair or set of contact beams 220, 242 are disposed along opposite sides 310, 312 of the module slot 308. The module slot 308 is shaped to receive and align the card module 400 with respect to the mating ends 222, 234 of the outer and center contacts 120, 118.

As shown in FIG. 3, the retention features 224 of the outer contact 120 may extend into the interior chamber 304 to engage the contact base 114. The curved shape of the retention features 224 shown in the embodiment illustrated in FIGS. 2 and 3 may permit the outer contact 120 to snap onto the contact base 114 to secure the outer contact 120 to the contact base 114 without use of solder or another component, such as an adhesive. Alternatively, the retention features 224 may not be bent when the retention features 224 are loaded into the contact base 114. After loading the retention features 224 in the contact base 114, the retention features 224 may be bent to secure the outer contact 120 to the contact base 114.

Figure 4:
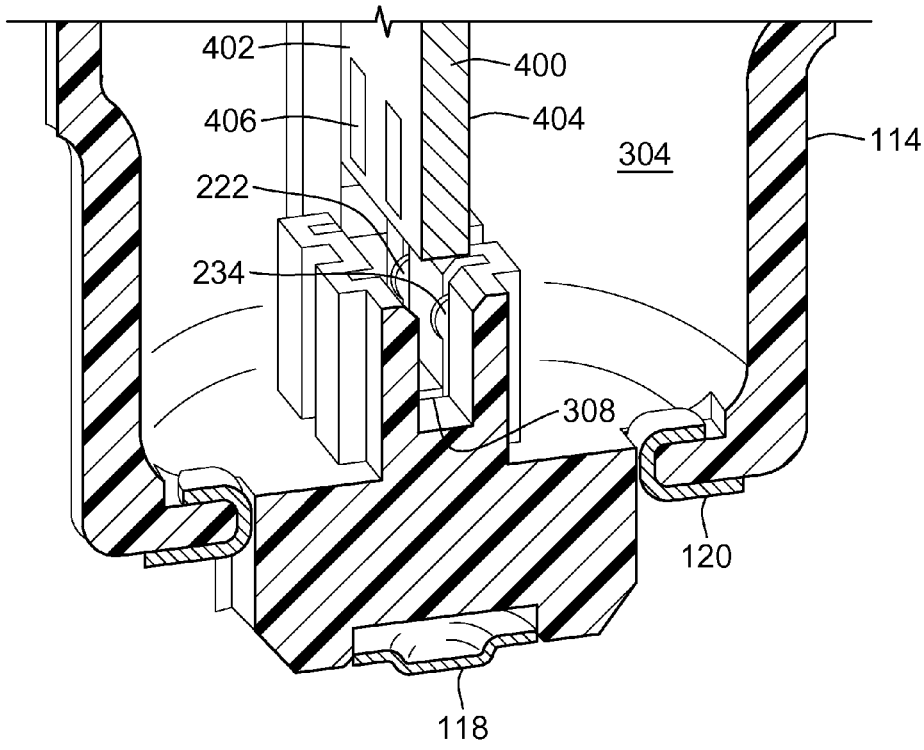
FIG. 4 is partial cross-sectional view of the contact base of the lamp assembly shown FIG. 1 in accordance with one embodiment of the present disclosure.

FIG. 4 is a partial cross-sectional view of the contact base 114 of the lamp assembly 102 in accordance with one embodiment of the present disclosure. As described above, the card module 400 may be, loaded into the module slot 308 in the interior chamber 304 of the contact base 114. The card module 400 may be a circuit board having one or more electrical components 500 (shown in FIG. 5) mounted thereon. For example, the card module 400 may be a printed circuit board having one or more LED drivers, resistors, capacitors, and the like, mounted thereto. The electrical components 500 may receive electric current from the power source 136 (shown in FIG. 1) and modify the current for the light sources 112 (shown in FIG. 1). By way of example only, the electrical components 500 mounted to the card module 400 may include LED drivers that step down the voltage of the electric, current received by the card module 400 from the power source 136 via the socket 104 (shown in FIG. 1) and the center and outer contacts 118, 120.

The card module 400 has opposite sides 402, 404. One or more of the sides 402, 404 may include conductive pads 406. The conductive pads 406 include, or are formed from, a conductive material, such as a copper-based alloy. The conductive pads 406 are electrically interconnected with the electrical components 500 (shown in FIG. 5) mounted to the card module 400. For example, one or more conductive traces (not shown) may extend through the card module 400 between the conductive pads 406 and the electrical components 500. The center and outer contacts 118, 120 of the contact base 114 mate with the conductive pads 406 when the card module 400 mates with the contact base 114. The contact beams 242, 220 (shown in FIG. 2) of the center and outer contacts 118, 120 engage the conductive pads 406 on one or more of the sides 402, 404 to electrically couple the card module 400 with the center and outer contacts 118, 120 when the card module 400 is loaded into the module slot 308 of the contact base 114. For example, the mating ends 234, 222 of the center and outer contacts 118, 120 may contact the conductive pads 406. The contact beams 242, 220 may be outwardly biased away from one another when the card module 400 is inserted between opposing pairs of the contact beams 242, 220 to establish a pressure termination connection between the contact beams 242, 220 and the card module 400. Such a pressure termination connection may avoid the need for additional securing components or materials, such as solder, to be applied between the center and outer contacts 118, 120 and the card module 400.

The card module 400 may receive electric current from the power source 136 (shown in FIG. 1) once the card module 400 is mated with the center contact 118 and the center contact 118 engages the feed line contact 134 (shown in FIG. 1) of the socket 194 (shown in FIG. 1). The card module 400 may be coupled with the ground reference 138 (shown in FIG. 1) once the card module 400 is mated with the outer contact 120 and the outer contact 120 engages the internal threaded surface 124 (shown in FIG. 1) of the socket 104.

Figure 5:
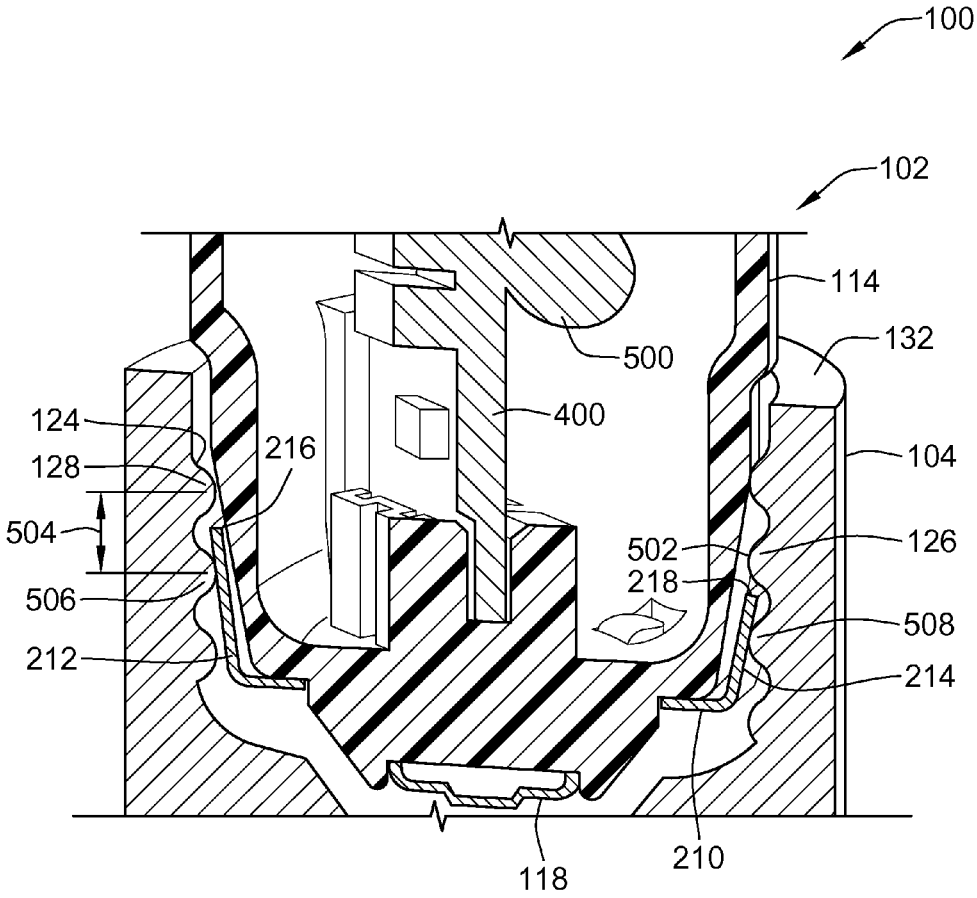
FIG. 5 is a partial cross-sectional view of the lighting system shown in FIG. 1 in a mated relationship in accordance with one embodiment of the present disclosure.

FIG. 5 is a partial cross-sectional view of the lighting system 100 in a mated relationship in accordance with one embodiment of the present disclosure. The contact base 114 of the lamp assembly 102 is shown mated with the socket 104 in FIG. 5. Additionally, the card module 400 is shown as mated with the contact base 114 in FIG. 5. As described above, the internal threaded surface 124 of the socket 104 includes an internal thread comprised of several thread portions 126, 126. The thread portions 126, 128 may be adjacent ridges 502 of the internal thread separated from one another by the thread pitch 504. Alternatively, the thread portions 126, 128 may be non-adjacent ridges 502 that are separated from one another by a multiple of the thread pitch 504.

The contact tines 212, 214 of the outer contact 120 may be different lengths to engage different thread portions 126, 128 of the internal threaded surface 124. For example, as the contact tine 212 has a greater length from the ring body 210 of the outer contact 120 to the outer end 216 of the contact tine 212 than the length from the ring body 210 to the outer end 218 of the contact 214, the contact tine 212 may engage a different thread portion 128 than the thread portion 126 that is engaged by the contact tine 214 when the contact base 114 mates with the socket 104. As shown in FIG. 5, the longer contact tine 212 may engage the thread portion 216 that is located closer to the top end 132 of the socket 104 than the thread portion 218 that is engaged by the shorter contact tine 214. The contact tines 212, 214 may engage the thread portions 126, 128 when the outer ends 216, 218 of the contact tines 212, 214 are located between the corresponding thread portion 126, 128 and an adjacent thread portion 506, 508. For example, the contact tine 212 engages the thread portion 128 when the outer end 216 of the contact tine 212 is disposed between the thread portion 128 and the lower thread portion 506. The contact tine 214 may engage the thread portion 126 when the outer end 218 of the contact tine 214 is located between the thread portion 126 and the lower thread portion 508.

The contact tines 212, 214 engage the internal threaded surface 124 to electrically and mechanically couple the contact base 114 to the socket 104. The contact tines 212, 214 may permit a quick-installation of the contact base 114 into the socket 104. For example, the contact lines 212, 214 may only require less than one full or complete 360 degree rotation of the contact base 114 in the socket 104 to mechanically and electrically join the contact base 114 to the socket 104. The contact base 114 may mate with the socket 104 by pushing the contact base 114 down into the socket 104 until the center contact 118 engages the feed line contact 134 (shown in FIG. 1) of the socket 104 and then rotating the contact base 114 relative to the socket 104. By way of example only, while the outer ends 216, 218 of the contact tines 212, 214 may not be disposed between adjacent thread portions 126, 128, 506, 508 when the contact base 114 is first loaded into the socket 104, a quarter turn rotation, or a rotation of approximately 90 degrees or less, may be all that is required to move the outer ends 216, 218 into an engaged relationship with the internal threaded surface 124. For example, a quarter turn may be all that is required to position the outer ends 216, 218 between adjacent ridges 502 of the internal threaded surface 124. Alternatively, a different amount of rotation may be required to engage the contact tines 214, 214 with the internal threaded surface 124.

Figure 6:
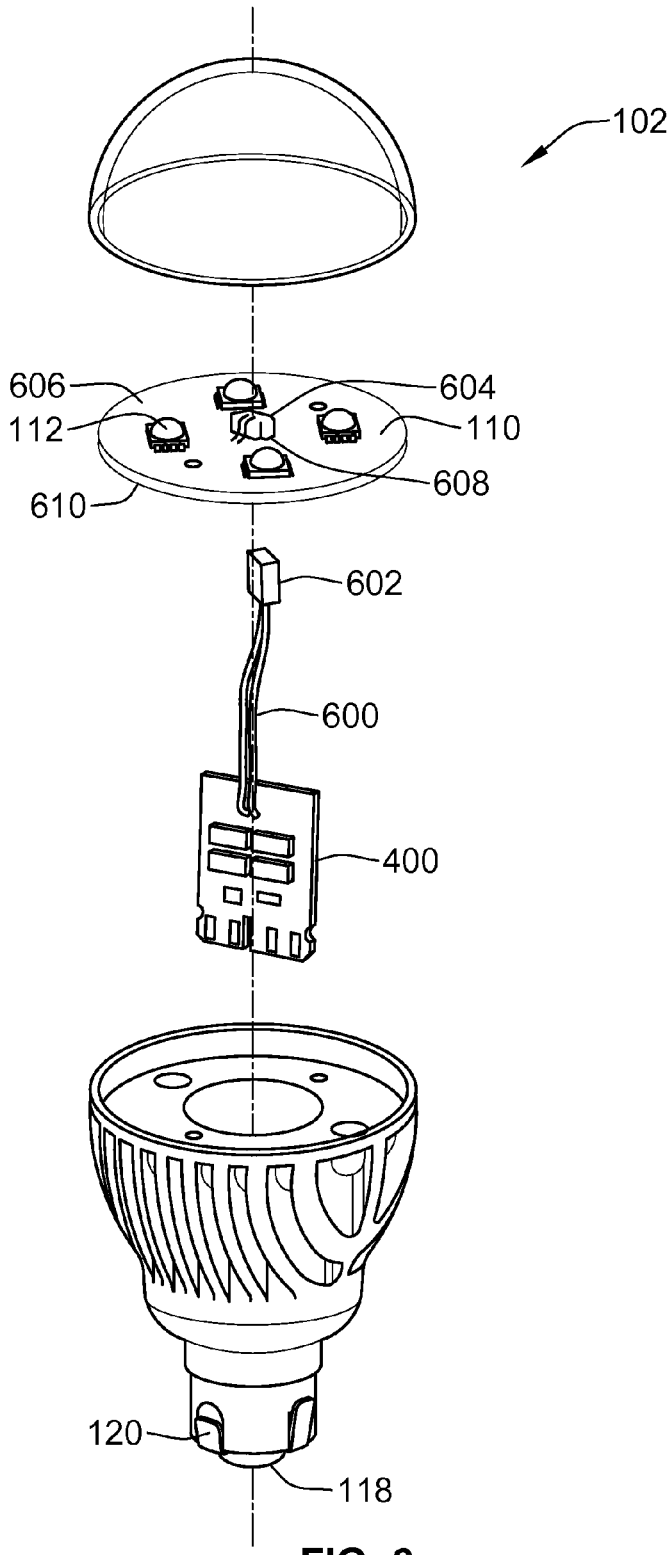
FIG. 6 is an exploded view of the lamp assembly shown in FIG. 1 in accordance with one embodiment of the present disclosure.

FIG. 6 is an exploded view of the lamp assembly 102 in accordance with one, embodiment of the present disclosure. The card module 400 is joined with wires 600. The number of wires 600 shown is merely an example. The wires 600 are flexible bodies that interconnect the card module 400 with a plug connector 602 and provide one or more electrically conductive pathways therebetween. In one embodiment, the plug connector 602 may be similar to the plug end of the mating connector shown and described in the '241 Application and the GI-00677 Application. For example, the plug connector 602 shown in FIG. 6 may have similar dimensions, and/or shapes as the mating connector described as "mating connector 102" and/or the plug end described as "plug end 106" in the '241 and the GI-00677 Applications.

A through board connector assembly 604 may be mounted to the circuit board 110 of the lamp assembly 102. The through board connector assembly 604 may be similar to the through board connector assembly described and shown in the '241 and the GI-06677 Applications. For example, the through board connector assembly 604 may receive the plug connector 602 to electrically couple the card module 400 with the through board connector assembly 604 via the wires 600. The card module 400, the wires 600 and/or the plug connector 602 may constitute an intervening connector that electrically couples the center and outer contacts 118, 120 of the contact base 114 with the light sources 112. The through board connector assembly 604 is mounted to one side 606 of the circuit board 110, extends through an opening 608 in the circuit board 110 and protrudes from an opposite side 610 of the circuit board 110. The through board connector assembly 604 receives the plug connector 602 below the circuit board 110 when the through board connector assembly 604 and the plug connector 602 mate with one another. The through board connector assembly 604 is electrically coupled with the light sources 112 such that the through board connector assembly 604 interconnects the light sources 112 with the card module 400 via the wires 600 and the plug connector 602.

Figure 7:
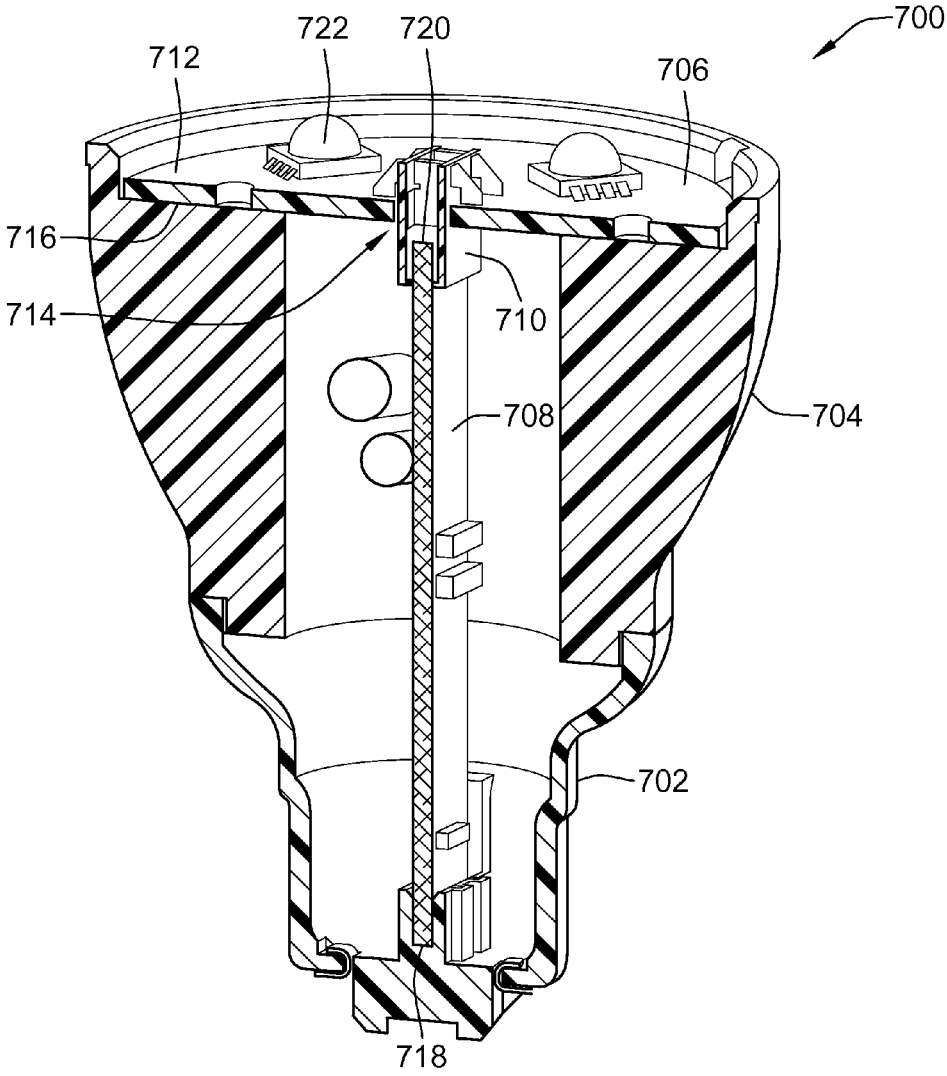
FIG. 7 is a partial cross-sectional view of a lamp assembly in accordance with another embodiment of the present disclosure.

FIG. 7 is a partial cross sectional view of a lamp assembly 700 in accordance with another embodiment of the present disclosure. The lamp assembly 700 may be similar to the lamp assembly 102 (shown in FIG. 1). For example, the lamp assembly 700 may include a contact base 702 that is similar to the contact base 114 (shown in FIG. 1), a heat sink 704 that is similar to the heat sink 108 (shown in FIG. 1), and a lens (not shown) that is similar to the lens 106 (shown in FIG. 1). Some differences between the lamp assembly 102 and the lamp assembly 700 are related to a circuit board 706 and a card module 708 in the lamp assembly 700.

The circuit board 706 may be similar to the circuit board 110 (shown in FIG. 1) of the lamp assembly 102. For example, the circuit board 706 may include several light sources 722 that are similar to the light sources 112 (shown in FIG. 1). One difference between the circuit board 706 and the circuit board 110 is that the circuit board 706 may include a through board connector assembly 710 that differs from the through board connector assembly 604 (shown in FIG. 6) of the circuit board 110. In one embodiment, the through board connector assembly 710 is similar to a connector assembly shown and described in the GI-00677 Application. For example, the through board connector-assembly 710 may have similar dimensions and/or sizes as the "connector assembly 602" shown and described in the GI-00677 Application. In the illustrated embodiment, the through board connector assembly 710 is mounted to one side 712 of the substrate 706, extends through an opening 714 of the substrate 706, and protrudes from an opposite side 716 of the substrate 706.

The card module 708 may be similar to the card module 400 (shown in FIG. 4) of the lamp assembly 102 with one exception being that the card module 708 interconnects the contact base 702 with the circuit board 706. The card module 708 includes opposite edges 718, 720 that mate with the contact base 702 and the through board connector assembly 710. The card module 708 may constitute an intervening connector that electronically couples the contact base 702 with the light sources 722. The card module 708 may mate with each of the contact base 702 and the through board connector assembly 710 to electrically couple the contact base 702 and the through board connector assembly 710 without the use of additional intervening components, such as the wires 600 (shown in FIG. 6). In one embodiment, the card module 708 is a single body that continuously extends from the contact base 702 to the through board connector assembly 710 to couple the contact base 702 to the through board connector assembly 710. The card module 708 may be a rigid or flexible body. For example, the card module 708 may be a rigid circuit board. In another embodiment, the card module 708 is a flexible body, such as a flexible printed circuit board or a flex circuit. The card module 708 conveys electric current between the contact base 702 and the circuit board 706 and may couple the circuit board 706 to a ground reference such as the ground reference 138 (shown in FIG. 1).

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A lamp assembly configured to mate with a socket having an internal thread, the lamp assembly comprising:

a light source configured to generate light;

a contact base extending from a lower end to an upper end along a center axis, the upper end interconnected with the light source, the lower end configured to be received in the socket to mate the contact base with the socket;

a center contact disposed proximate the lower end of the contact base, the center contact electronically coupled with the light source; and an outer contact comprising a ring body and an elongated contact tine, the ring body encircling the center contact proximate the lower end of the contact base, the elongated contact tine extending from the ring body to an outer end at an angle with respect to the center axis of the contact base, wherein the center contact and the outer contact mechanically and electrically couple with the socket and electrically join the light source with an electric ground reference.

2. The lamp assembly of claim 1, wherein the center contact includes a contact beam upwardly extending from the center contact in a direction along the center axis of the contact base, the contact beam configured to mate with a card module in the contact base to electronically couple the center contact with the card module.

3. The lamp assembly of claim 1, wherein the outer contact includes a contact beam upwardly extending from the outer contact in a direction along the center axis of the contact base the contact beam configured to mate with a card module in the contact base to electronically couple the outer contact with the card module.

4. The lamp assembly of claim 1, wherein the outer contact includes a plurality of the elongated contact tines coupled to and extending from the ring body in directions that are angled with respect to the center axis of the contact base, a first one of the contact tines having a greater length between the ring body and the corresponding outer end than a second one of the contact tines.

5. The lamp assembly of claim 1, wherein the outer contact includes a plurality of the elongated contact tines coupled to and extending from the ring body, further wherein first and second ones of the contact tines engage different portions of the internal thread of the socket.

6. The lamp assembly of claim 1, wherein the outer contact engages the internal thread of the socket to secure the contact base in the socket by loading the outer contact into the contact base in a direction along the center axis and rotating the contact base by less than 360 degrees.

7. The lamp assembly of claim 1, wherein the center contact is disposed between the contact base and the socket and aligned with the center axis of the contact base when the contact base mates with the socket.

8. The lamp assembly of claim 1, wherein the center and outer contacts mate with a card module loaded into the contact base, the contact base including an interior surface that defines an interior chamber into which the card module is loaded, the interior surface having a slot configured to receive a card module and align the card module with respect to the center and outer contacts.

9. The lamp assembly of claim 1, further comprising a circuit board to which the light source is mounted and a through board connector assembly mounted to the circuit board and electronically coupled to the light source, the through board connector assembly configured to mate with an intervening connector that electronically couples the center and outer contacts with the light source.

10. The lamp assembly of claim 9, wherein the through board connector assembly and the light source are mounted to one side of the circuit board and the through board connector assembly extends through and protrudes from an opposite side of the circuit board through an opening in the circuit board.

11. A contact base for a lamp assembly having a light source, the contact base comprising:

an elongated body extending between a lower end and an upper end along a center axis, the upper end interconnected with the light source, the lower end configured to be received in a socket having an internal thread to mate the lamp assembly with the socket;

a center contact disposed proximate to the lower end of the elongated body between the lower end and the socket when the elongated body is loaded into the socket, the center contact configured to be electronically coupled with the light source; and an outer contact comprising a ring body and an elongated contact tine, the outer-contact configured to be electronically joined with the light source, the ring body encircling the center contact proximate the lower end of the contact base, the contact tine extending from the ring body to an outer end, wherein the center and outer contacts engage the socket and electronically couple the light source with the socket and the elongated contact tine engages the internal thread of the socket and secures the base to the socket.

12. The contact base of claim 11, wherein the center contact includes a contact beam upwardly extending from the center contact in a direction along the center axis of the elongated body, the contact beam configured to mate with a card module in the contact base to electronically couple the center contact with the card module.

13. The contact base of claim 11, wherein the outer contact includes a contact beam upwardly extending from the outer contact in a direction along the center axis of the contact base, the contact beam configured to receive and mate with a card module in the contact base to electronically couple the outer contact with the card module.

14. The contact base of claim 11, wherein the outer contact and the center contact include opposing contact beams upwardly extending in directions along the center axis, the contact beams configured to mate with opposite sides of a card module through a pressure termination.

15. The contact base of claim 11, wherein the outer contact includes a plurality of the elongated contact tines coupled to and extending from the ring body in directions that are angled with respect to the center axis of the body, a first one of the contact tines having a greater length between the ring body and the corresponding outer end than a second one of the contact tines.

16. The contact base of claim 11, wherein the outer contact includes a plurality of the elongated contact tines coupled to and extending from the ring body, further wherein first and second ones of the contact tines engage different portions of the internal thread of the socket.

17. The contact base of claim 11, wherein the outer contact engages the internal thread of the socket to secure the elongated body in the socket by loading the outer contact into the contact base in a direction along the center axis and rotating the elongated body and the outer contact by less than 360 degrees.

18. The contact base of claim 11, wherein the center contact is disposed between the elongated body and the socket and aligned with the center axis of the elongated body when the elongated body mates with the socket.

19. The contact base of claim 11, wherein the elongated body includes an interior surface that defines an interior chamber and the center and outer contacts mate with a card module loaded into the interior chamber, the interior surface having a slot configured to receive and align the card module with respect to the center and outer contacts.

20. The contact base of claim 11, wherein the center contact is electronically coupled with a feed line contact of the socket and the outer contact is electronically coupled with an electric ground reference via the internal thread of the socket when the center and outer contacts engage the socket.

* * * * *